United States Patent [19]

Johns

[11] 4,076,311

[45] Feb. 28, 1978

[54] HYDRAULIC MINING FROM TUNNEL BY RECIPROCATED PIPES

[76] Inventor: Robert W. Johns, 349 Ashley Crescent SE., Calgary, Alberta, Canada

[21] Appl. No.: 653,037

[22] Filed: Jan. 28, 1976

[30] Foreign Application Priority Data

Jan. 29, 1975 Canada ..... 218912

[51] Int. Cl.[2] ..... E21C 45/00

[52] U.S. Cl. ..... 299/2; 299/11; 299/17

[58] Field of Search ..... 299/2, 17, 19, 11; 166/50; 175/67, 422

[56] References Cited

U.S. PATENT DOCUMENTS

| | | | |
|---|---|---|---|
| 2,682,396 | 6/1954 | Haworth | 299/2 |
| 2,783,972 | 3/1957 | Fehlmann | 175/422 |
| 2,822,158 | 2/1958 | Brinton | 299/5 X |
| 3,153,290 | 10/1964 | Saito | 175/422 X |
| 3,934,935 | 1/1976 | Lambly et al. | 299/2 |
| 3,957,308 | 5/1976 | Lambly et al. | 299/17 X |

*Primary Examiner*—Ernest R. Purser
*Attorney, Agent, or Firm*—Shlesinger, Arkwright, Garvey & Dinsmore

[57] ABSTRACT

The invention relates to the hydraulic underground mining of bituminous sands, oil shales and other friable mineral deposits. Accordingly, the invention resides in the provision of a tunnel complex at or near the base of the deposit, in which tunnels are driven parallel one with the other, and spaced a substantial distance apart. An exemplary distance would be in the region of 2,000 feet. Hydraulic excavators are driven outwardly from the sides of the tunnels until the excavator heads are in a position substantially midway between adjacent tunnels. The excavators are arranged in a multiple array at spaced intervals along the tunnels, these intervals being adjusted such that there is interaction during operation, between adjacent excavator heads. The excavators may be positioned in two or more tiers by insertion into the deposit at differing angles from the operating tunnel, such that interaction between excavators is in two dimensions, horizontal and vertical. By systematic and programmed reciprocating movement of the individual excavators over a progressively enlarging "active zone", interacting between excavators is increased to three dimensions, horizontal, vertical, and lateral, thus effectively extending the "active zone" and increasing the volume of material being excavated. The ejector head, in addition to being provided with a multiplicity of nozzles through which fluid may be ejected at high pressure, also includes an intake or suction nozzle through which the fluidized sand, or slurry may be removed from the "active zone". The excavating nozzles are additionally spaced around the excavator head so that, at any time, certain nozzles are excavating below the intake nozzle to provide and evacuate a space into which oversized material can accumulate without plugging the intake. The nozzles being additionally spaced at predetermined angles relative to the excavator head so that they excavate both ahead of the intake nozzle and laterally thereof. In this manner, the excavation is both advanced, and expanded laterally.

11 Claims, 23 Drawing Figures

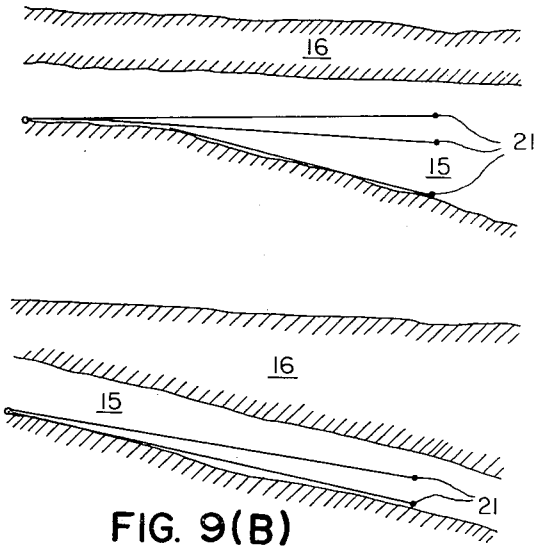
FIG. 9(A)
FIG. 9(B)
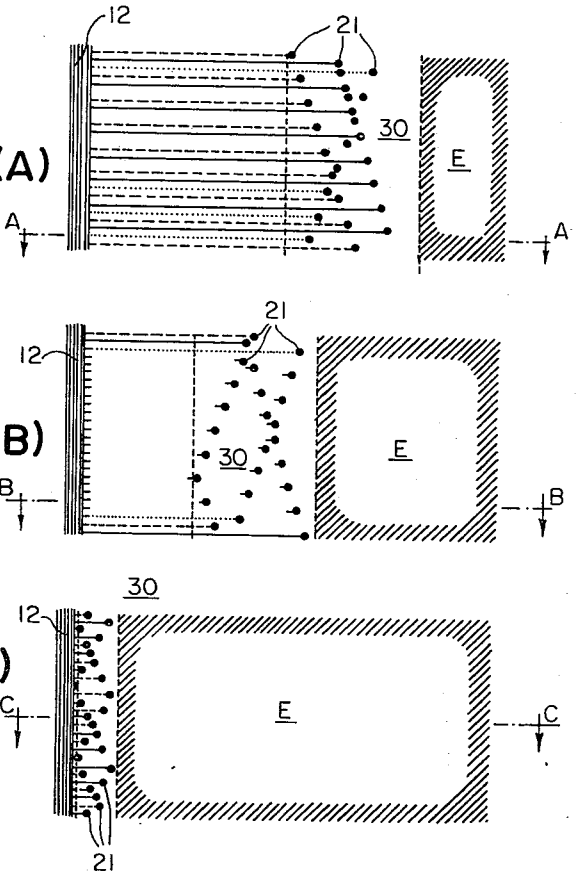
FIG. 7(A)
FIG. 7(B)
FIG. 7(C)

HYDRAULIC MINING FROM TUNNEL BY RECIPROCATED PIPES

This invention relates to the hydraulic, underground mining of bituminous sands, oil shales, and other friable mineral deposits.

The recovery of petroleum from naturally occurring bodies of bituminous sands and shales has long presented problems of practical significance because of the mining problems involved. In the Athabasca area of Alberta, Canada, there occur extensive deposits of sediments, known as the "McMurray sediments", which are deposited on Pre-Cretaceous erosion surfaces generally of Devonian Limestone. The sediments comprise relatively coarse sands, overlain by a mantle of glacial drift, which varies in depth from a few feet adjacent the Athabasca river, to in excess of 1,800 feet at a distance of several miles from the Athabasca river.

The McMurray sediments extend over approximately 9,000 square miles, in only approximately 7% of which is the overburden less than 100 feet in depth, and in only 20% of this area is it less than 250 feet (Alberta Oil & Gas Conservation Board "A Description and Reserve Estimate of the Oil Sands of Alberta, 1963").

At some time during the geological history of the McMurray sediments, they were invaded by some 600 billion barrels of oil. The McMurray sediments themselves extend from 100 to 200 feet in thickness, and the oil content of the sediments is roughly one barrel of oil per cubic yard of sands; one cubic yard of oil-saturated sand weighs approximately one ton.

The top of the McMurray formation is relatively flat, and its varying thickenss is due to the topography of the Pre-Cretaceous erosional surface on which it rests.

Heretofore, two separate and distinct approaches have been used, or conceived in exploiting the McMurray oil sands. Initially, and to date the only commercial method has been that of surface mining of the sands, in which a location is selected where the overburden does not extend to a depth greater than approximately 20 feet. The overburden is stripped with draglines or scrapers, to expose the top of the oil sands, and various mining techniques are then employed in order to mine the sands, which are then transported by conveyor or mine trucks to a separation plant, for separating the oil from the coarse sands. Large shovels, mining wheels, rippers and scrapers have heretofore been employed in the mining process. The Great Canadian Oil Sands Ltd. plant at Mildred Lake, Alberta, utilizes large mining wheels, mounted in outboard fashion on booms, in which cutter-equipped buckets are rotated around a wheel, the cutters engaging the exposed oil sands face on a mining bench, each cutter-equipped bucket slicing a cut of several inches of sand from the face.

The economics of such surface mining procedures have restricted the operations to areas of relatively low overburden, and it has generally been conceived that development of the major portion of the oil sands must depend on in situ methods. Such in situ methods have been experimental, and generally have involved underground combustion or solution mining, in which a dliuent such as kerosene, or steaming, is injected into the formation through input boreholes for recovery of the diluent and entrained oil from adjacent output boreholes. Although the economic results of such in situ methods have not been published, it is generally believed that such methods are not commercially practicable because of the relatively high losses of the recovery agents and energy employed.

The heavy asphaltic oil in the oil sands is the bonding agent which consolidates the sand into a quasi-sandstone. The oil is heavy gravity (from 8° API to 12° API), viscous especially at low temperatures; the formation temperature of the oil sands is around 40° F.

Although the oil has much the same general properties throughout the formation, there are some differences. In the McMurray area, the oil has specific gravities of 1.020 to 1.025 and is much more viscous than the oil from elsewhere in the formation, where the oil has specific gravities of 1.005 to 1.010. Oil of specific gravities of 1.000 or somewhat less have been observed at the bottom of the formation.

The only commercial plant to date in the McMurray area, that of Great Canadian Oil Sands Ltd., has a design capacity of 100,00 tons per day of mined sand. Engineering estimates of optimum plant sizes suggest that only large scale operation of at least 100,000 tons of sand per day can be expected to reduce unit costs to the point where the recovered bitumen will be competitive with conventionally obtained crude oil.

Another huge source of synthetic crude oil occurs in the Colorado oil shales in which the hydrocarbon occurs in shale beds, the costs of production appearing to significantly exceed the costs of oil production from the Athabasca oil sands.

It is basic to the concept of this invention that, except for the relatively small areas adjacent the athabasca river of low overburden, and therefore amenable to surface mining, any economic recovery of the major portions of the McMurray bitumen will depend on the development of an economic underground mining method.

One such underground mining method has been proposed by the present applicant, and is under active development. This method is described in U.S. patent application Ser. No. 509,489, filed Sept. 26, 1974, and entitled "Method and Apparatus For Mining Tar Sands, Oil Shales and Other Minerals"now U.S. Pat. No. 3,958,830

The invention contemplated by this prior application describes a method and apparatus for the underground mining of deposits of particulate bedded material, in which a laterally extending underground mining face is established against which a laterally extending mining shield is positioned, the mining shield serving to partially enclose mining machinery such as lateral shearing ploughs, rotary cutters or the like which are conventional in underground coal mining. The cutter operates across the full length of the mining wall and the mined material, after being cut from the mining face falls onto a lateral conveyor and is then conveyed from the face to collecting means, operating at the ends of the face for ultimate conveyance through a shaft to the ground surface.

As an alternative approach to the problem of mining oil bearing sands, the present applicant has devised a technique, which will be described hereafter, and which utilizes hydraulic excavators.

Hydraulic mining per se is not new, indeed the application of underground hydraulic mining methods for the recovery of oil from unconsolidated sands has been the subject of numerous patent specifications, one of which being U.S. patent Ser. No. 1,936,643 (W. C. Laughlin), dated Nov. 21, 1933.

The Laughlin process involves the driving of tunnels beneath the deposit, and the application of hot water through fixed pipes projecting upwardly into the deposit, the pipes being spaced at intervals along the tunnel. The objective being to fluidize the oil sand which will then pass downwardly through outlet pipes into the tunnels for ultimate removal to a separation plant.

This prior process, while theoretically viable, cannot be accepted as a practical method of mining tar sands for two basic reasons, the first being that of economy. As will be appreciated, to put this invention into practice, the area beneath the deposit must be literally crisscrossed with tunnels, and, in order to achieve the required interaction between the fixed sets of water pipes extending upwardly from the adjacent tunnels, the tunnels must be spaced closely together, perhaps less than 40 feet apart. The spacing of adjacent groups of water pipes along each tunnel must also be such that interaction is possible, since due to their fixed position, the area, or volume of oil sand, in which each group of pipes is capable of excavating, is restricted.

Apart from the cost involved in providing the necessary operating equipment to effectively work such a vast area of deposit, the energy required to maintain the operation of the many hundreds of pumps and auxiliary equipment, would, it is submitted, far exceed the energy value of the recovered product.

The second and perhaps more serious problem to be faced by implementing this prior system is the danger of flooding. In hydraulic mining, one of the greatest hazards to operating personnell is that the excavation can be too successful. That is especially a hazard in mining unconsolidated sands as there is no limit at which excavation can be definately stopped.

It is likewise a hazard in thick deposits, for the operators, faced with a seemingly boundless supply in front of him, to over enthusiastically continue excavation until a huge volume has been removed thereby producing an unfilled void. Uncontrolled removal of material may leave an unsupported roof of great extent, which, when it collapses, may (in a fraction of a second), displace and thrust a large volume of water, or slurry, with irresistable violence, into the underground workings.

Equally destructive is that a large volume of air may also be displaced, and forced at high velocity into the mine tunnels.

If water-bearing aquifers are encountered, thousands of tons of water may be released into the mine workings, or similarly, as is common in the working of oil sands, quicksand-like concentrations may also be encountered which would flow into the mined workings with a speed equal to that of water, and cause a similar degree of damage.

With the Laughlin process, where perhaps thousands of gallons of water are being forced into an area immediately above the operating tunnels the danger of flooding is magnified to an extent that the process must be considered impractical.

It is to avoid the hazards indicated above, and to additionally provide a more economical mining system that the present invention has therefore been developed.

Accordingly, the invention resides in the provision of a tunnel complex at or near the base of the deposit, in which tunnels are driven parallel one with the other, and spaced a substantial distance apart. An exemplary distance would be in the region of 2,000 feet. Hydraulic excavators are driven outwardly from the sides of the tunnels until the excavator heads are in a position substantially midway between adjacent tunnels. The excavators are arranged in a multiple array at spaced intervals along the tunnels, these intervals being adjusted such that there is interaction during operation, between adjacent excavator heads. The excavators may be positioned in two or more tiers by insertion into the deposit at differing angles from the operating tunnels, such that interaction between excavators is in two dimensions, horizontal and vertical. The ejector head, in addition to being provided with a multiplicity of nozzles through which fluid may be ejected at high pressure, also includes an intake or suction nozzle through which the fluidized sand, or slurry may be removed from the "active zone". The excavating nozzles are additionally spaced around the excavator head so that, at any time, certain nozzles are excavating below the intake nozzle to provide and evacuate a space into which oversized material can accumulate without plugging the intake. The nozzles being additionally spaced at predetermined angles relative to the excavator head so that they excavate both ahead of the intake nozzle and laterally thereof. In this manner, the excavation is both advanced, and expanded laterally.

As the description of the method and apparatus of this invention proceeds, it will be appreciated that, although the principal application of the invention is in bituminous sands, the same may have application in shale having bitumen content, and other bedded deposits such as potash, nitrates, coal and other friable mineral susceptible to the hydraulic mining technique hereinafter described.

Since various modifications can be made to the invention herein described within the scope of the invention concept disclosed, it is not intended that protection of the said invention should be interpreted and restricted to the particular modifications of the known parts of such concept as particularly described, defined, or exemplified, since this disclosure is intended to explain the construction and operation of such concept and is not for the purpose of limiting protection by any specific embodiment thereof.

In the drawings, like characters of reference indicate corresponding parts in the several figures.

Proceeding therefore, to describe the invention in detail, reference should be had to the accompanying drawings in which.

Figure 5:
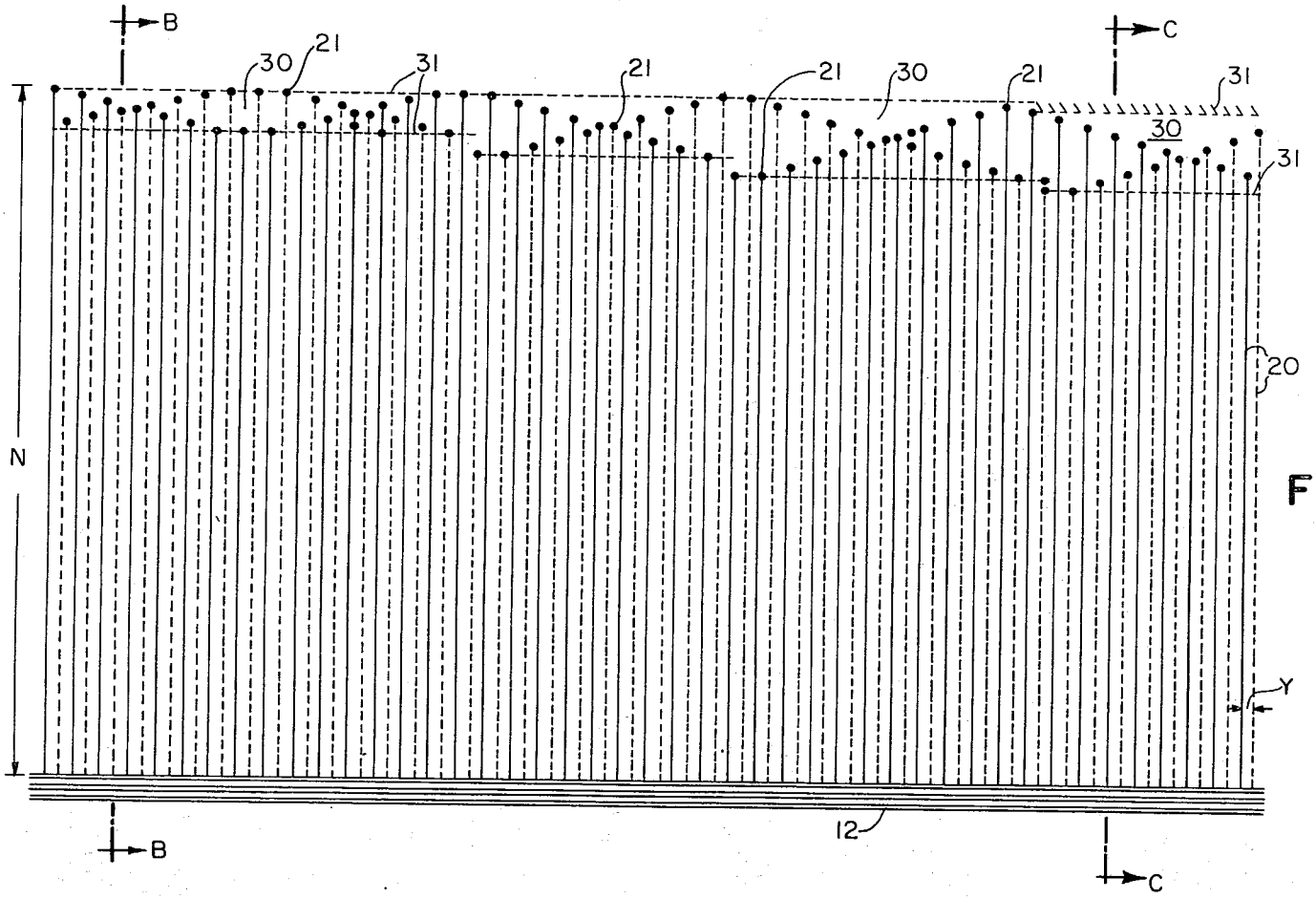
FIG. 5 is a plan view showing the arrangement of excavators from a mining tunnel, and the progressive development of the working face, or active mining zone remote from the tunnel.
Figure 6A:
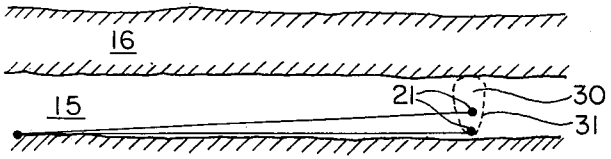
FIG. 6 (A) is a cross-section of FIG. 5, at B—B, at start of excavation; two hydraulic excavators in operation.
Figure 6B:
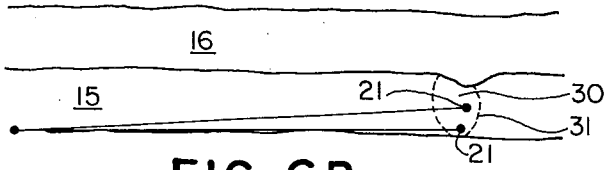
Figure 6C:
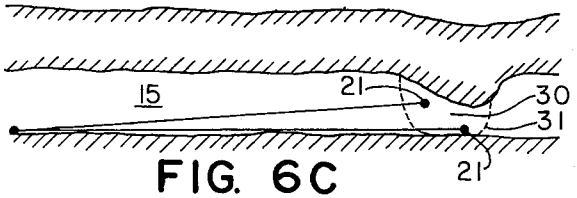
Figure 6D:
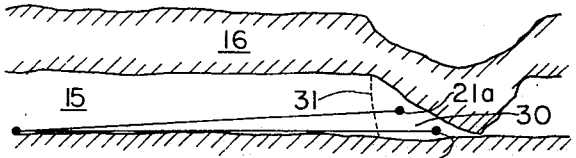

FIG. 6 (B) and 6 (C) are cross-sections of FIGS. 5 at B — B, but show the progressive enlargement of the active mining zone and surface subsidence;

FIG. 6(D) is a cross-section of FIG. 5, at C—C, shows excavation of desirable horizon completed at extreme end of hydraulic excavator and systematic development of the active zone.

Figure 10:
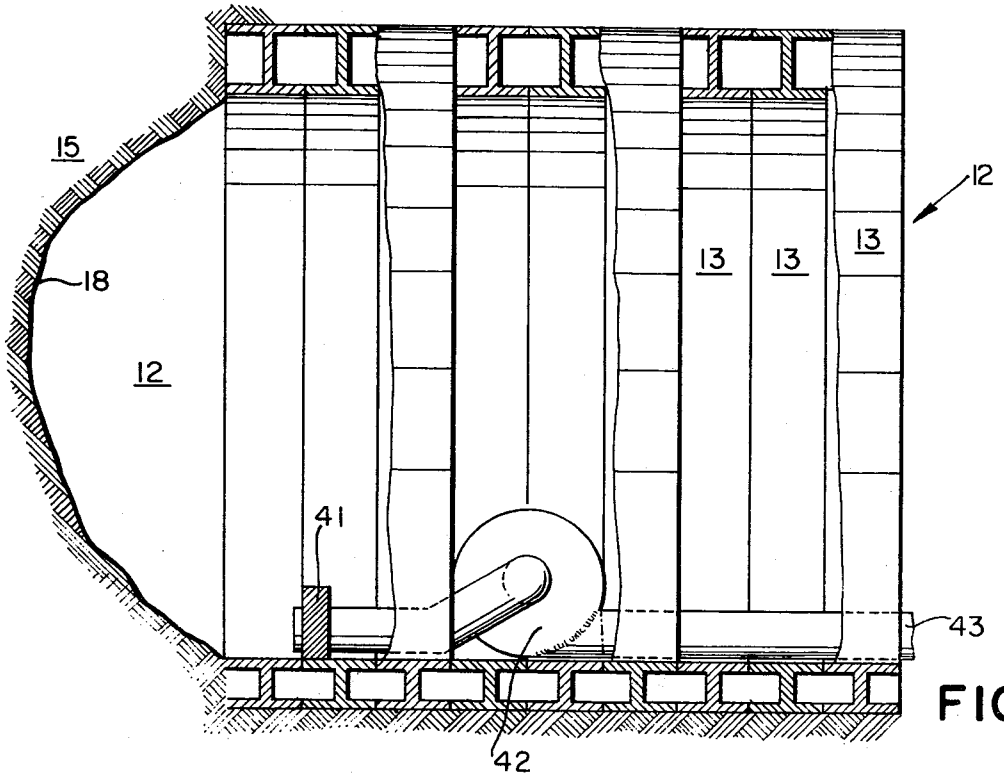
Figure 11:
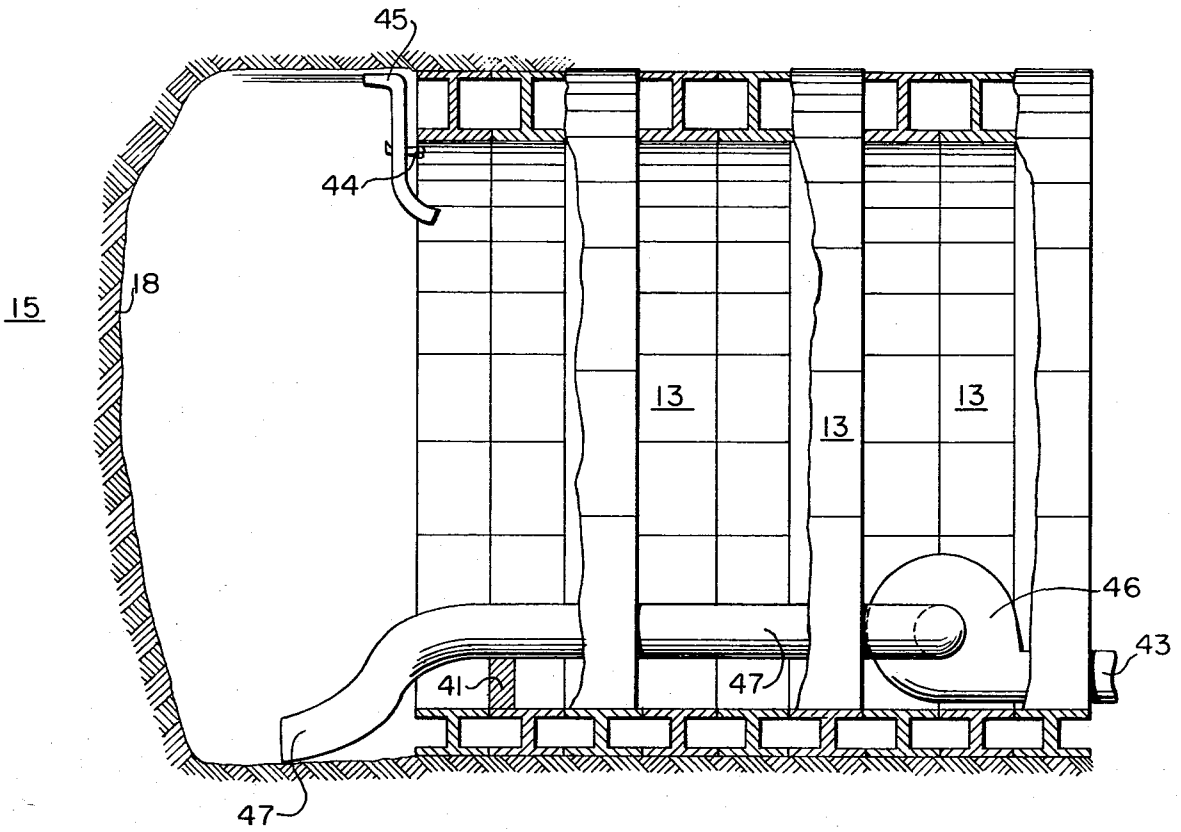
Figure 12:
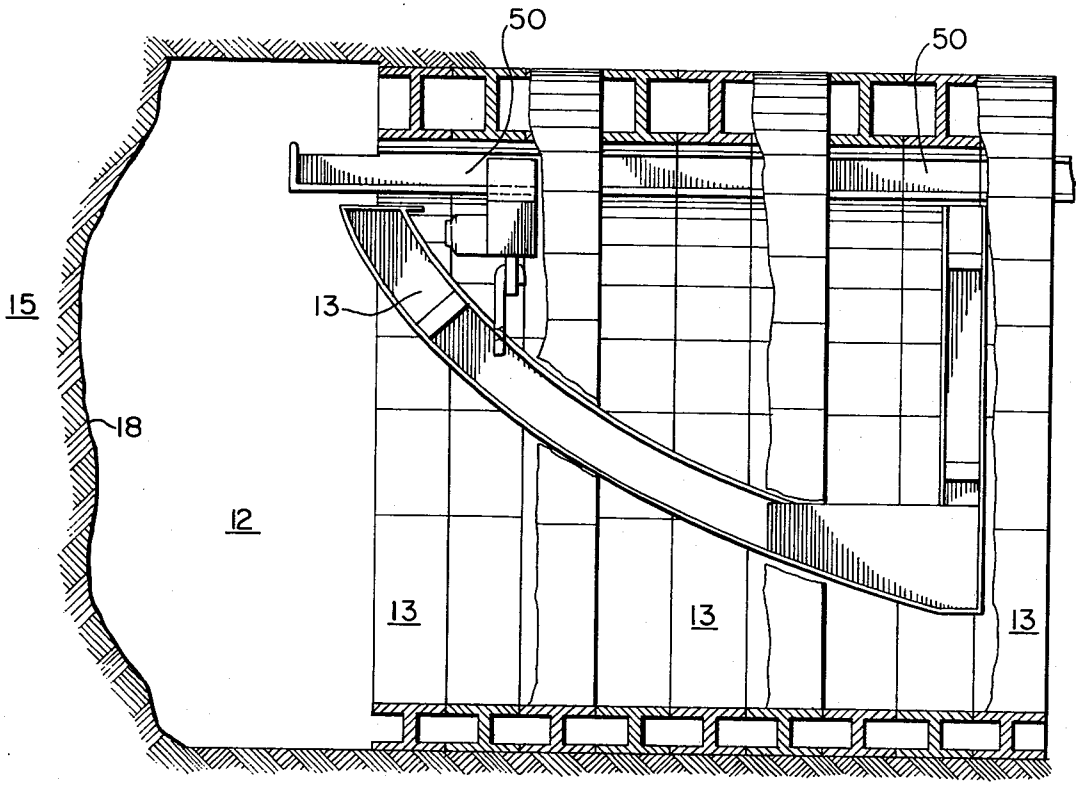
Figure 13B:
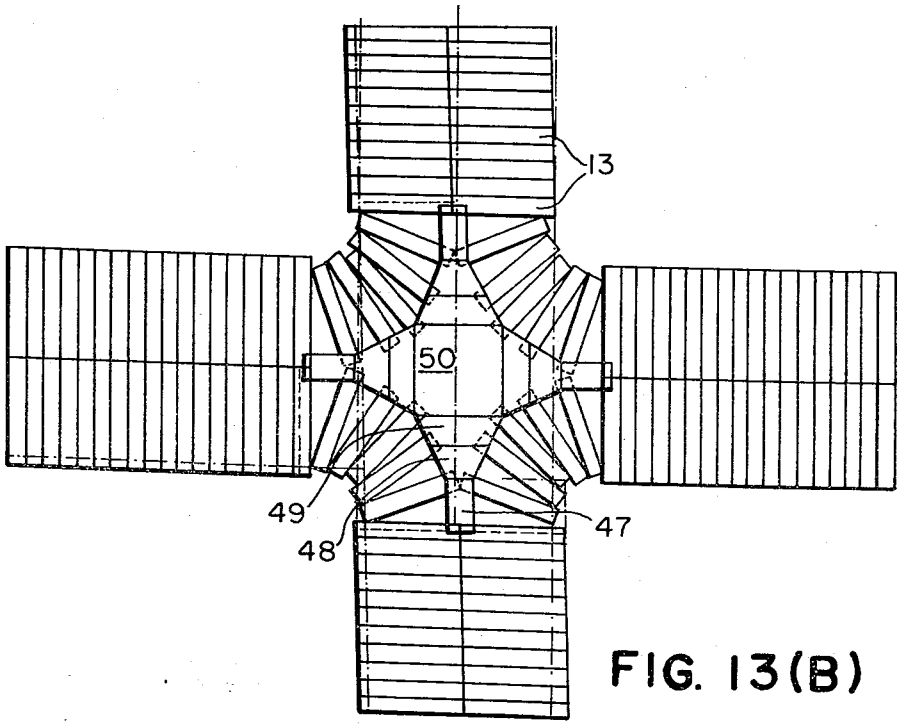
Figure 13A:
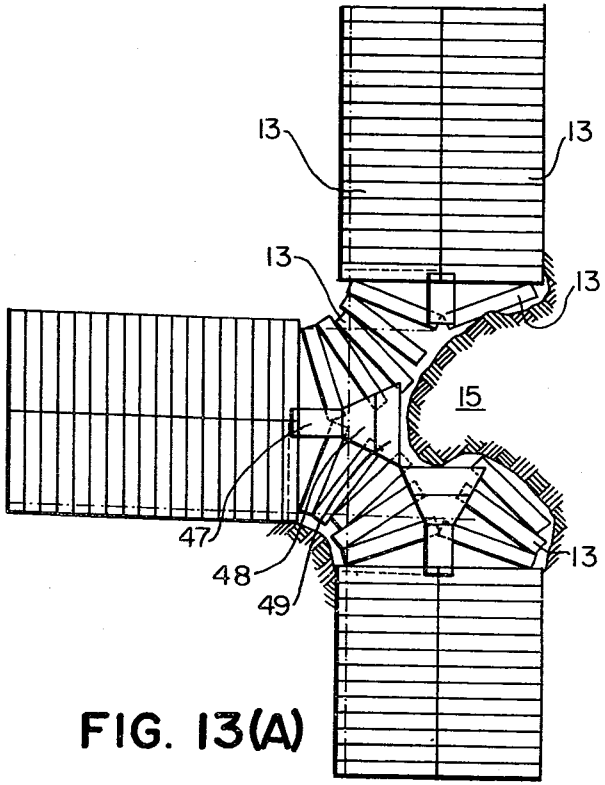
Figure 14:
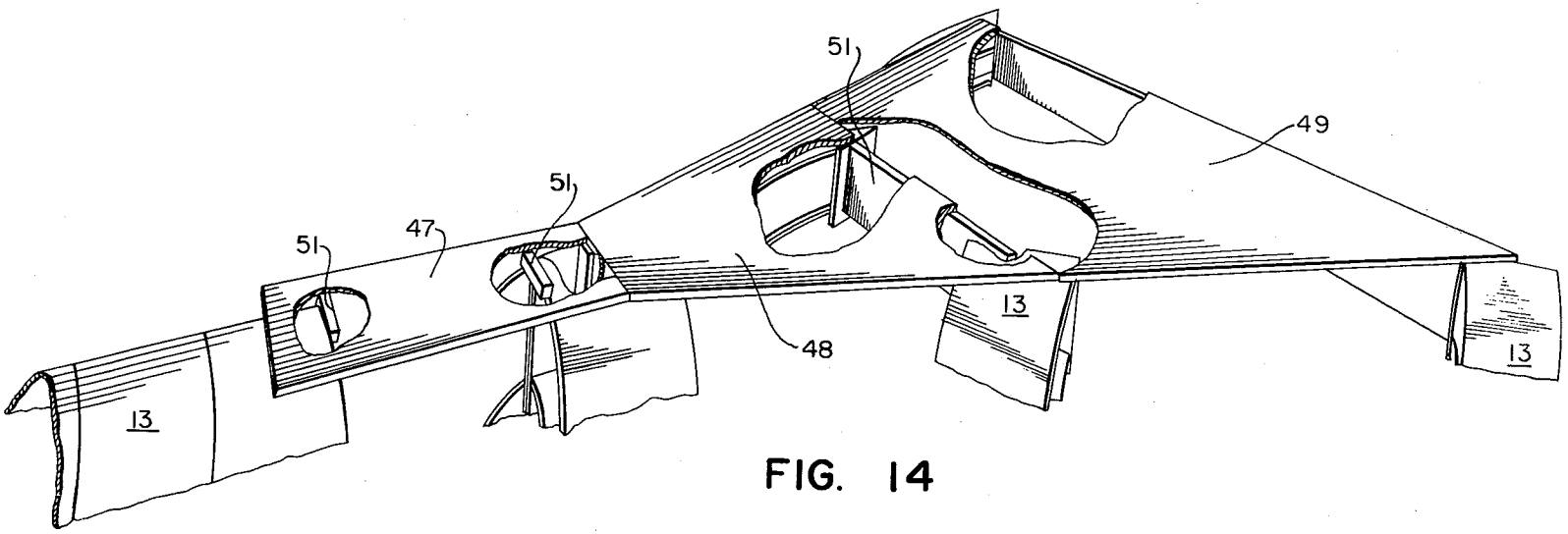

FIG. 7 shows the complete mining operation from an intermediate (A) to Final (C) stage, the worked out area being shown at (E);

FIG. 8 (A), (B), and (C) are sections taken at A—A, B—B and C—C, respectively, of FIG. 7, showing enlargement of active mining zone and progressive subsidence;

FIG. 9 (A) shows application of the mining technique according to the invention applied to thickening stratographic section, three excavators in operation;

FIG. 9 (B) shows application of the mining technique according to the invention applied to dipping stragographic section, two excavators in operation;

FIG. 10 is a longitudinal section through a mining tunnel in the process of construction, showing start of excavation, retaining dam, and slurry pump;

FIG. 11 is the longitudinally section of FIG. 10 showing a hydraulic, tunnel profile excavator and flexible slurry removal;

FIG. 12 shows the transportation of Fixed Arch tunnel sections, by monorail, for positioning in the excavated area;

FIG. 13 (A) is a plan view of an intersection between mining tunnels, partially completed;

FIG. 13 (B) is a plan view of a completed intersection; and;

FIG. 14 shows the method of assembly of the adaptor plates utilized in the intersection of FIG. 13.

In the embodiment of the method of the invention illustrated in the drawings, the novel mining system is being used to mine a body of sands 15 by the simultaneous operation, of a number of hydraulic excavators 20, the excavated material in the form of a slurry, being transported by conventional means, such as pumps from the operating tunnels 12 for conventional removal to the surface. The mining operation is carried out from operating tunnels 12 positioned at or near the base of the bituminous sand deposit, the mining operation being continued by the gradual withdrawl of the excavators towards the tunnels 12, together with the reciprocation of the excavators to ultimately achieve a substantially complete removal of the entire deposit. This reciprocal movement of the excavators is accomplished in a programmed manner using conventional rod and pipe handling equipment or the like (not shown).

The principal operating tunnel 12 is excavated, preferably by hydraulic means, and lined with arch sections 13, in a manner to be described in detail hereafter. The arch sections 13, do not form part of the present invention, since they are disclosed in and form part of applicant's earlier filed U.S. Pat. No. 3,958,830. Each arch section however, comprises, as can be seen from FIG. 1, a base portion forming a flow and a cantilever portion extending upwardly from said base portion at a generally acute angle and forming a roof. The arch sections are free from any permanent interconnection.

As can be seen from the drawings, a hydraulic excavator 20 is driven laterally into the stratographic horizon 15 within which excavation is to be initiated, horizon 15 being overlain by a presumably barren material, and also underlain by a material not requiring excavation.

Preferably, as previously indicated, operating tunnel 12 is located at or near the base of the deposit and the hydraulic excavators 20 extend laterally from the tunnel 12, however there may be particular conditions to be later described where this arrangement is changed for best utility.

It is however important that the hydraulic excavator 20 remains within the deposit under excavation.

Figure 1:
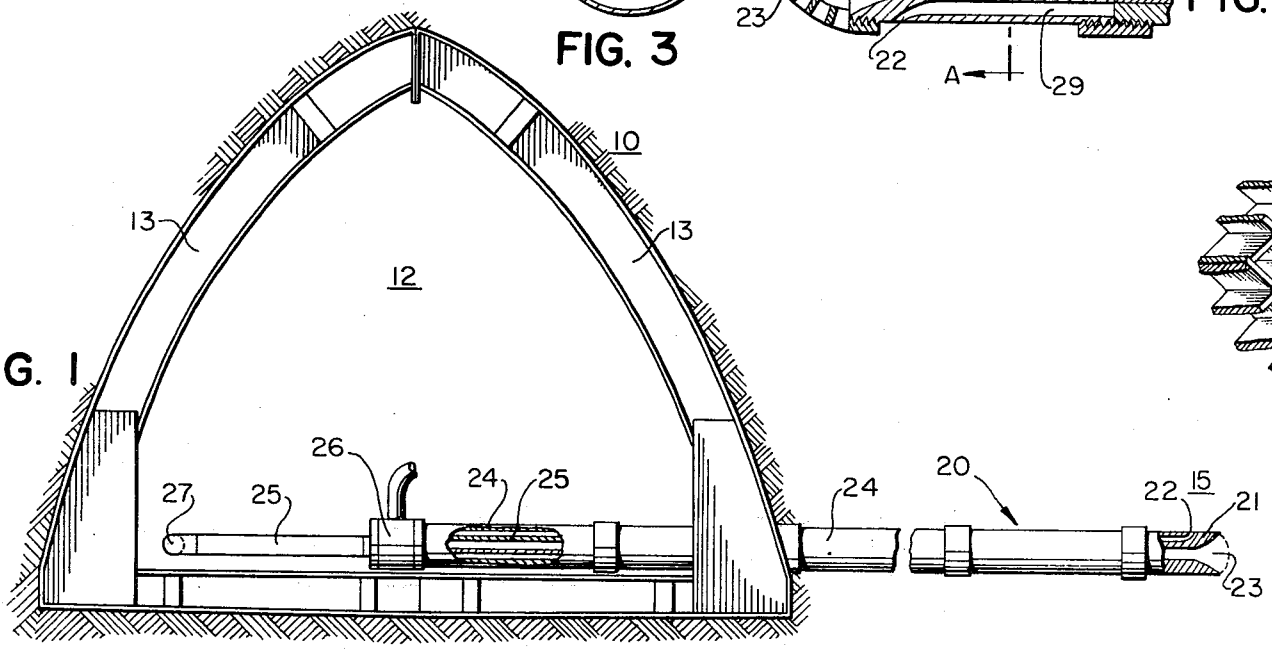
FIG. 1 is a section through a mining tunnel constructed with double Fixed Arch sections and with one hydraulic excavator installed, portions of which are partially sectioned.

As can be seen from FIG. 1, the excavator 20 consists of an operating head 21, mounted remotely on the outer end of the excavator 20, which is formed in sections, and consists of an outer pipe 24, and an inner slurry pipe 25.

The water pipe 24 is fitted with a water swivel 26, which permits the slurry pipe 25 to pass therethrough, during which operation the water pressure is sealed. The slurry pipe 25 is connected to a conventional slurry pump (not shown) through a swivel connection 27.

Both the outer water pipe 24 and the inner slurry pipe 25 are made in segments, the length of each segment being sufficient to permit manipulation of these pipes within the operating tunnel. This segmentation permits the excavator 20 to be lengthened, or reduced in length by the addition or subtraction of single segments within the access tunnel 12.

Conventional rod and pipe handling, not shown, is used to remove or add segments, and is controlled from an operators platform (not shown), which may be suspended from a monorail 50' (FIG. 12), in the upper space of tunnel 12.

Figure 2:
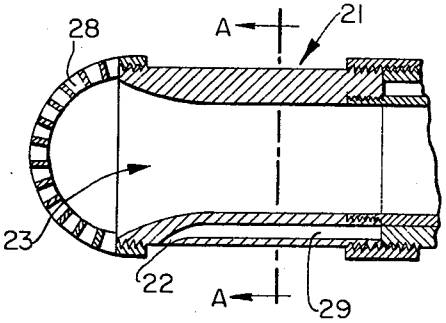
FIG. 2 is an enlarged section of the head or nozzle of the excavator of FIG. 1.

With reference to FIG. 2, the operating head 21, incorporates a multiplicity of oblique pressure nozzles 22 surrounding a suction orifice 23 which is protected by screen 28. The screen is intended primarily to exclude the coarse material from the slurry pump. While the pump might be quite capable of handling material in sized up to the full diameter of the slurry pipe 25, a portion which was only slightly greater in diameter would obviously plug the whole system. The screen 28 is therefore important to hold larger particles away from the throat of the orifice 23.

Figure 4:
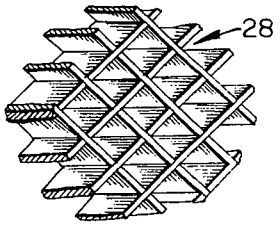
FIG. 4 is a projected view of the nozzle screen, of FIG. 2.

The same possibility of plugging by particles slightly larger than the openings in the screen, is also present, so the screen is made with the sides of the openings parallel as shown in FIG. 4. The screen is also subject to distortive forces when the excavator is being advanced or turned, so the screen is preferably constructed of interlocking welded plates.

Returning to FIG. 2, the operating head is shown in section to disclose conduits 29 which are cast or machined within the head 21, and convey the water, under pressure, from the water pipe 24 (FIG. 1) to the pressure nozzles 22. The suction orifice 23 connects directly to the slurry pipe 25.

Figure 3:
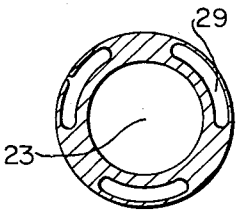
FIG. 3 is a cross-section of the nozzle of FIG. 2, taken at A—A of FIG. 2.

FIG. 3 is a cross-section of the operating head 21 and shows the co-actual relationship of the water channels in the conduits 29 and the slurry orifice 23.

The pressure nozzles 22 are machined such that the high-pressure water jets are directed outward and ahead of the excavator so that they impinge the surrounding material close to the plane of the screen 28, and as material is washed away, extend the volume being slurried ahead of the operating head 21.

In view of the multiplicity of pressure nozzles 22, slurry production is not confined to one quadrant surrounding the operating head 21.

FIG. 5 shows in plan, a typical layout for a multiplicity of hydraulic excavators 20 driven from one side of a tunnel 12. It will be appreciated, that this is not meant to be restrictive, since under certain circumstances, excavation could quite easily be carried out simultaneously through both sides of tunnels 12. Exemplary dimensions might be that the total extension of excavator 20 from 12 (distance Z), might be 1,000 feet, and the distance Y between adjacent excavators 20 might be in the region of 30 feet. Once again, no restriction is intended, since dependent upon topography of the deposit, constituency of unconsolidated sand and operating conditions, the quoted distances may be extended, or reduced accordingly.

In operation, the excavators 20 are advanced into their fully extended condition by a "washing" method whereby they are pressed ahead by hydraulic rams (not shown), acting upon the water swivel 25, while the water is introduced under medium pressure. Thus, pressure nozzles 22 act as a washing agency ahead of the operating head 21, the minor volume of slurry produced as the excavators are driven through the deposit being removed through the central slurry pipe 25.

Both the material cut and slurried, and the water necessary to form the slurry must be removed from the advancing excavator head and the slurry pump must have capacity to handle the volume of slurry/water produced, and the type of slurry formed. For example, should a thick slurry be formed, the pump must be capable of providing the extra power necessary to remove it from the workings. It is therefore important that during the positioning of the excavation head, prior to the start of active mining an optimum balance of water-sand is maintained sufficient only to permit passage of the head to its mining location.

During the advance of the operating head 21, and at frequent intervals thereafter, samples are taken from all excavators 20 to ensure that they are operated within the oil bearing deposit. If the samples from certain excavators 20 are found to be barren, those excavators are withdrawn or advanced, to a position where the samples again show evidence that oil bearing sand is being contacted.

FIGS. 6A, 6B, 6C, and 6D are sections taken through the layout of FIG. 5.

FIG. 6A shows the development of an active zone 30 within the limits 31. Two hydraulic excavators 20 are shown as operating in this section. Under optimum conditions, it may be possible to achieve the extent to the active zone 30 of the figure from only one excavator 20. This would mean that the characteristics of the material being excavated were completely amenable to progressive excavation of the material and the progressive caving of the same material until a section had been removed from top to bottom of the desirable stratographic horizon 15.

FIGS. 6B through D show the active zone 30 increasing in volume, the overburden 16 beginning to subside into the active zone in FIG. 5B, which condition will progress until the material constituting the overburden 16 begins to appear in the samples from excavators 20.

In the sections shown in FIGS. 6A, 6B, 6C, and 6D, two "tiers" or layers of excavators 20 are shown. One excavator being driven at an angle above the lower excavator. This configuration is not mandatory, but will give greater excavating effect should a single layer of excavators not produce slurry in the guantity desired, and of the desired constituency.

Attention at this point is again directed to FIG. 5, which shows an expediency which may be necessary to promote excavation, this being the systematic movement of the operating heads 21 of the excavators 20 through an extended active zone 30. Beginning with all the excavators advanced the full distance N, one excavator is withdrawn the length of one segment of excavator pipe. This displaces the point of impact of the high-pressure water jets.

Successive excavators are withdrawn systematically until the location of the operation heads 21 is as shown in FIG. 5, which produces a wider active zone 30 than would be produced by a single row of operating heads 21 all at the same distance said from the operating tunnel 12. If the effect of two or more layers of excavators 20 with angle between them, as in FIG. 6, is added to the effect of staggering the operating heads 21, the effect is substantially increased.

Referring to FIG. 6D, the upper layer of excavator heads 21A will, in operation, be restricted into the deposit when overburden appears in the samples, thus extending the active zone 30. Excavating continuing thereafter until over burden 16 appears in the samples from the lower excavator head 21B.

As can be seen from FIGS. 7A, 7B, and 7C, active zone 30 will move progressively closer to the operating tunnel 12, followed by increasingly larger barren volume indicated at E.

Figure 8A:
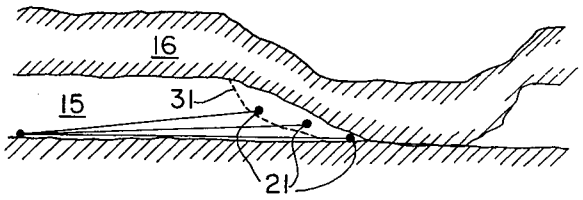
Figure 8B:
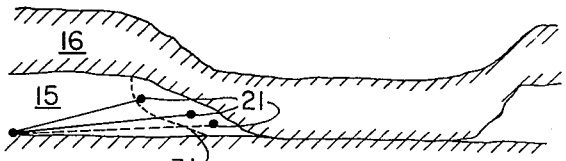
Figure 8C:
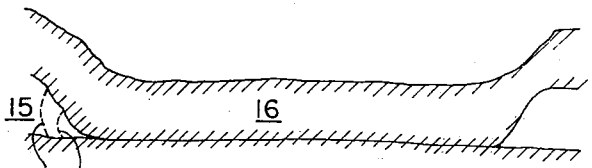

Looking now to FIGS. 8A, 8B, and 8C, these show sections corresponding to the progressive removal of the body of ore 15, as shown in FIGS. 7A, 7B, and 7C. The active zone 31 will always be removed from direct connection with the operation tunnel 12.

As is known, variations in thickness of the stratographic horizon 15 can cause problems during mining. FIGS. 9A and 9B however, show that any variation in thickness that may be encountered can be accommodated by proper placement of the excavators.

As will be appreciated, the operating tunnels, their formation, and implacement, are of considerable importance to the system of the present invention, since before a layout of excavators 20, as shown in FIG. 5, can be installed, there must be tunnels available from which the excavators can be advanced.

Dependent on topographical location, access to the bituminous sand reserve will be established by means of vertical or inclined shafts, or alternatively, adits, by means of which the reserve is penetrated to its lower level, adjacent the base of the material.

The characteristics of the reserve will have been determined by preliminary core drilling, and a mining plan established. Essentially, a number of tunnels will be driven, an initial distance into the deposit, generally horizontally and parallel with one another, and spaced apart a distance in the order of 2,000 feet. The walls and overhead are supported within the tunnels by the installation of a double set of mining arches 13 (FIG. 1) installed in inwardly facing pairs and in side-abutting relationship. No interlocking of adjacent arches being necessary since the collapsing bituminous material is adequate to secure the arches in position. As previously described, hydraulic excavators 20 will then be driven into the deposit from one or both sides of the operating tunnel, and excavation of the deposit commenced.

It is however invisaged that the operating tunnels will be extended to open up new areas of the deposit for excavation, therefore, the implacement of tunnels will be a continuing process, the layout of excavators (FIG. 4) continually expanding as the work-out volume E (FIG. 7) expands. When, in the initial section of excavation, the conditions as shown in FIG. 8C are reached, the excavators 20 will be removed, transported to the newly excavated stretch of tunnel where they can be set up to commence excavation as before.

As mining proceeds across the deposit, the operating tunnel 12 to the rear of the working zone, which is now passing through worked-out material can, if not required for slurry-conveying pipe, or general access, be dismantled, and the fixed arch sections reused to line the advancing tunnel.

While it is appreciated that the tunnels can be driven, and lined by conventional tunnelling methods, it is preferable that the method of tunnelling should be compatible with the hydraulic handling of the production slurry. Therefore, a method of hydraulic tunnelling is included within the system of the present invention, and will now be described by way of reference to FIG. 10, 11, and 12.

FIG. 10 shows the initial stage of excavating an opening for tunnel 12, to extend that portion of tunnel already lined with arches 13.

An expandable and removable dam 41 is placed across tunnel 12 to prevent the water and slurry from flooding the tunnel.

A high pressure water jet (not shown), is directed against the face 18 and the resulting slurry is removed from ahead of the dam 41 by a slurry pump 42, which is connected to a slurry conveying pipe 43.

FIG. 11 represents the next stage of tunnel excavation, where, as the excavation ahead of the tunnel is expanded, the profile of the tunnel 12 is cut by profile water jets 45, which are moved, manually or mechanically around the tunnel linings 13 and are positioned by a stop 44 such that they excavate only to the limit of the tunnel outline.

In addition to the slurry pipe 43 at the region of the dam 41 (FIG. 10), a second slurry pump 46, with a flexible intake pipe 47' (FIG. 11) would preferably be employed to remove the slurry from below the level of dam 41. The two slurry pumps being employed to further prevent the possibility of flooding.

Looking now to FIG. 12, the stage has now been reached where excavation has been progressed far enough for the tunnel to be lined. Fixed arches 13 are brought via an overhead monorail conveyor 50' to the newly excavated portion of tunnel 12 where they are advanced into the excavation and placed in position. This process is repeated until the newly excavated portion of tunnel is completely lined. As indicated previously, the arch sections used to line the newly excavated stretches of tunnel can be taken from the worked-out sections of the mine workings.

While it is desirable to advance tunnels, there is also occassion when it is desirable to intersect or cross two tunnels.

The intersection may be head on, with one tunnel running directly into another horizontally, or the tunnels may intersect at differing angles (FIG. 13B).

FIG. 13A and 13B shows a method of forming intersections which utilizes the fixed arches 13 in conjunction with adaptor plates 47, 48, 49, and 50. FIG. 13A shows an intersection under construction, where FIG. 13B shows a completed intersection, the adaptor plates locked into position with the respective fixed arch section.

An intersection is formed by spacing the fixed arches 13 so that they form a cruciform intersection design, binding them together with the adaptor plates and then introducing concrete to form a rigid assembly.

The procedure for constructing the intersection depends on the stability of the material at the point of intersection. If the opening will stand unsupported for a period of time to allow the full pattern of arches and adaptor plates to be set up at one time, without roof support, then the full pattern as shown in FIG. 13B can be constructed.

However, when the roof is not capable of remaining unsupported for the necessary period of time, the intersection must be constructed in stages, excavation of the intersection being a gradual process, keeping pace with the assembly of the various arches, and adaptor plates.

FIG. 14 shows in partial section the method of assembling adaptor plates 47, 48, and 49, each of the adaptor plates being simply placed in abutting relationship one with the other, and maintained in position by positioning stops 51. The final stage in the construction of an intersection being the metallic lagging of the arches on the lower flanges thereof, and the forcing of concrete into the interstice between the arches to structurally key the whole intersection. This provides a structure which is far stronger than the unsupported double arch.

The operation of the apparatus, and the procedure involved in the method, no doubt, sufficiently appear from the foregoing description. It is therefore considered hereafter to recapitulate in general outline only.

Water under pressure is pumped, through the water swivel 27 (FIG. 1) into the water pipe 24 and is forced via the water conduits 29 out through the pressure nozzles 22.

The force of the water jets from pressure nozzles 22 erodes the desirable sand around the operating head 21 forming a slurry which is swept through the screen 28 into the orifice 23 and out the slurry pipe 24 by the slurry pump (not shown).

As will be appreciated, the slurry producing capability of the water jet will depend on the water pressure; the distance of impact from the nozzle (the impace effect will diminish at about the inverse square of the distance the jet has to travel before impact); the cohesion of the sand; and the ability of the sand to form a slurry.

Given high enough water pressure, a water jet will form a slurry of some type. This slurry may only be formed within a short distance, few inches from the nozzle and may be thin and tenuous.

Both the material cut and slurried, and the water necessary to form the slurry must be removed from the workings. There must be therefore an optimum ratio of water to sand for best economy. Should the slurry be too thick, a great deal of power would be required to remove it from the workings. Even if the slurry forms readily at the point of impact, it may separate almost immediately into water and a thick slurry. Thereafter, unless sufficient power is provided, removal of the thick slurry would probably be at a reduced rate thus causing the water fraction to build up to an extent where the excavating water jets would begin to impact on water, or to be discharged into water, thus nullifying the excavating effect.

A similar effect is produced if the screen becomes plugged with debris. In this case a back pressure forms, the active impact area becomes filled with water and the effect and excavating ability of the water jet is lost.

A multiplicity of water jets from a multiplicity of nozzles 22 around the operation head 21 helps to prevent the cutting effect of any one water jet effecting the operation of the whole operating head 21. Should the screen, for instance, become temporarily clogged with pebbles, the erosion of a pressure nozzle 22 directed below the operating head 21 would produce a space into which pebbles will drop.

Clogging of the screens 28 may also be rectified by back flushing; rotating the operating head; or moving the operating head by retracting and/or advancing the excavator 20.

The action of retraction, advancing, or turning of the excavator head would depend on the nature of the pipe used, and the adhesiveness of the material through which the excavator penetrates.

The excavator 20 must be free to rotate, and to move in and out when pressure is applied to the water swivel 25. This freedom of movement will be a function not only of the two factors mentioned above, but will be the determining factor in the maximum length of distance Z (FIG. 5) at which the excavator can function.

Even though the operating head 21 of excavator 20 is advanced and retracted, and turned about itself, a tunnel-like excavation may be produced. It is therefore, and has been mentioned, desirable that there be some interaction between the excavating head of one hydraulic excavator 20 and that of an adjacent excavator 20. This interaction, will cause the undesirable tunnel-like excavation to collapse, whereas no manipulation of one excavator 20 would be effective in achieving this purpose.

In more difficult cases, it may be necessary to excavate on several levels to promote a "fluidization" of a considerable volume of sand.

As previously suggested, still greater effectiveness would be produced by transversing the operating heads 21 across an active zone as depicted in FIGS. 5 and 6.

It may however be unnecessary to adapt any of these measures beyond that turning on the water and pumping out the slurry, with the exception that movement when the desirable stratographic horizone 15 is exhausted is obviously necessary. The technique according to the invention provides opportunity to adopt any measure that becomes necessary and to operate flexibility.

What is claimed is:

1. A method for the underground mining of subsidable mineral deposits comprising:

(a) providing at least one longitudinally extending tunnel within said subsidable deposit and adjacent the base thereof;

(b) inserting a plurality of hydraulic excavators a predetermined distance laterally into said deposits from at least one side of said tunnel, each of said excavators being positioned such that during operation, there is fluidic interaction between heads of adjacent excavators;

(c) commencing mining of said deposit at a location remote from said tunnel by fluidizing a zone of said deposit adjacent each said excavator head, and withdrawing mined material from said zone by suction;

(d) independently advancing and retracting each of said excavator heads, by programmed reciprocational movement thereof, thus expanding the fluidized zone over a predetermined distance, while permitting subsidence of minable material into said mining zone;

(e) continually extracting samples of mined materials from the material produced by each said excavator for determining the presence of any overburden therein;

(f) relocating each said excavator head by the retraction of each said excavator a predetermined distance towards said tunnel following evidence of overburden in said samples and continuing mining at the new location in the manner as originally done; and (g) terminating excavation by each said excavator when said mining zone lies adjacent said tunnel.

2. The method according to claim 1 including lining said at least one tunnel by the installation of a double set of mining arches installed in inwardly facing pairs and in side-abutting relationship, certain of said mining arches being adapted to provide access for said excavators to the mineral deposit.

3. The method according to claim 2 wherein the excavators are spaced one from the other in parallel array in the longitudinal direction of the tunnel and that during advancement to their respective mining locations, the distance therebetween is substantially maintained.

4. The method according to claim 1 wherein independent advancement of each said excavator to its mining location is achieved by:

(a) providing said excavator in a number of sections, each attachable one to the other;

(b) driving a first section carrying said excavator head into said deposit while passing sufficient pressurized fluid through said section to fluidize only the area immediately surrounding said head, the fluidized material being extracted by suction means via a suction port in said head;

(c) connecting, in fluid tight relation, a second excavator section to said first section and similarly driving said second section into said deposit;

(d) continuing the attachment, and driving, of subsequent excavator sections into said deposit, until the desired mining location has been reached.

5. The method according to claim 4 wherein reciprocation of said excavation heads to expand the mining zone is achieved by alternately withdrawing and advancing at least one section of said excavator within said tunnel.

6. The method according to claim 2 wherein said at least one tunnel is formed by hydraulic excavation, at least one main excavator being utilized to excavate in the direction of advance of said tunnel, and a tunnel profile excavator associated with said mining arches for movement thereon, said profile excavator being adapted to excavate only to the limit of the tunnel outline; the excavated material being removed by suction means.

7. The method according to claim 1 wherein a plurality of tunnels are provided, each adapted for progressive extension by hydraulic mining methods through said deposit, said tunnels being equidistantly spaced, parallel one with the other and wherein said excavators are extended laterally from each side of said tunnel to a mining position substantially mid-way between adjacent of said tunnels.

8. The method according to claim 3 wherein a first set of excavators are spaced one from the other and are extended in substantially parallel array into said deposit, and wherein additional excavators are positioned above said first set of excavators in one or more tiers and are extended into said deposit at differing angles to said first set of excavators.

9. A mining system comprising:

(a) at least one tunnel, within a sudsidable mineral deposit and adjacent the base thereof;

(b) a plurality of hydraulic excavators adapted to be extended laterally from at least one side of said tunnel a substantial distance into said deposit, each of said excavators including an excavator head having a plurality of nozzles for the emmission of fluid under pressure, and at least one suction nozzle for the withdrawal of mined material;

(c) means for supplying fluid under pressure to said excavator head;

(d) means for effecting withdrawal of mined material via said suction nozzle;

(e) means for reciprocating said excavator head within said deposit.

10. The system according to claim 9 and wherein said at least one tunnel comprises a plurality of oppositely disposed pairs of arch sections, each of said arch sections comprising a base portion forming a floor and a cantilever portion extending upwardly from said base portion at a generally acute angle and forming a roof, said arch section being free of any permanent interconnection.

11. The system according to claim 10 and wherein each said excavator is a compound tubular structure having a first passage therethrough for supplying pressurized fluid to said excavator head, and a second passage through which fluidized material can be withdrawn, each said excavator being additionally formed in longitudinal sections adapted for attachment one with the other in fluid tight relationship, the length of each said section being determined by the transverse dimensions of said tunnel.

* * * * *